US006186442B1

(12) United States Patent
Bittle

(10) Patent No.: US 6,186,442 B1
(45) Date of Patent: Feb. 13, 2001

(54) WING DEPLOYER AND LOCKER

(75) Inventor: David A. Bittle, Decatur, AL (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/160,197

(22) Filed: Sep. 4, 1998

(51) Int. Cl.[7] ..... F42B 13/32
(52) U.S. Cl. ..... 244/3.29
(58) Field of Search ..... 244/3.27, 3.28, 244/3.29; 16/334, 374

(56) References Cited

U.S. PATENT DOCUMENTS 2,960,296 * 11/1960 Sepp, Jr. ..... 244/149
3,103,886 * 9/1963 Popenoe ..... 244/3.29
4,974,289 * 12/1990 Picard ..... 16/334 X
5,464,173 * 11/1995 Sharrow et al. ..... 244/3.28 X

FOREIGN PATENT DOCUMENTS

2649643 A1 * 6/1978 (DE) ..... 244/3.29
2153982A * 8/1985 (GB) ..... 244/3.29

* cited by examiner

*Primary Examiner*—Michael J. Carone
*Assistant Examiner*—Jeffrey L. Gellner
(74) *Attorney, Agent, or Firm*—Arthur H. Tischer; Freddie M. Bush; Hay Kyung Chang

(57) ABSTRACT

In a flying object equipped with the wing deployer and locker, a torsion spring connecting the wing with the base deploys the wing upon the release of the object from its storage canister and, after the wing has reached a certain degree of deployment, a tapered tooth that protrudes from the base engages a matching slot in the wing boss to lock in the wing at the moment the wing obtains the fully-deployed position. The taper angle of the tooth and the slot compensates for manufacturing tolerances and provides a positive, solid locking action for the duration of the object's flight.

10 Claims, 3 Drawing Sheets

WING DEPLOYER AND LOCKER

DEDICATORY CLAUSE

The invention described herein may be manufactured, used and licensed by or for the Govennment for governmental purposes without the payment to me of any royalties thereon.

BACKGROUND OF THE INVENTION

The state-of-the-art in compact wing opening and locking technology is a ring pin mechanism in which a spring-loaded ring pin engages matching holes in the wing root and fixed base. This design suffices for applications where stresses are not great and positive (tremor-less) locking is not required. Some of the other designs use a tab protruding from the wing root which fits into a recess in the flying object's (such as a missile) body itself. Such a design provides positive locking action but at the expense of compactness. Further, the amount of stress that can be tolerated is limited by the width of the tab.

SUMMARY OF THE INVENTION

When the flying object is released from its storage canister, a torsion spring connecting the wing with the base deploys the wing and after the wing has reached a certain degree of deployment, a tapered tooth that protrudes from the base engages a matching slot in the wing boss to lock in the wing at the moment the wing obtains the fully-deployed position. The taper angle of the tooth and the slot compensates for manufacturing tolerances and provides a positive, solid locking action.

DESCRIPTION OF THE PREFERRED EMBODIMENT

Figure 1:
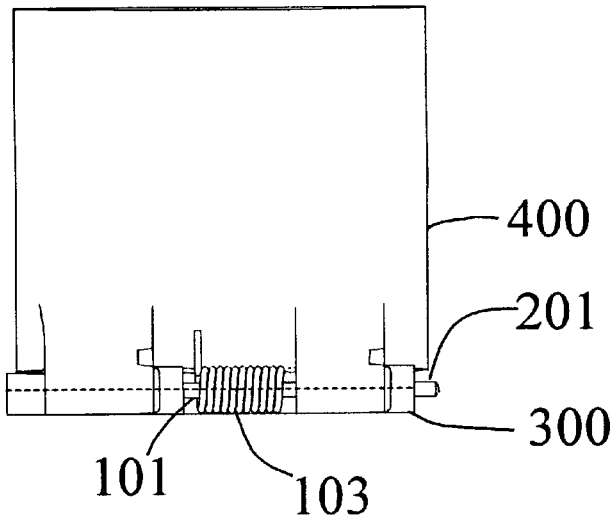
FIG. 1 is a frontal view of the preferred embodiment of the wing deployer and locker.
Figure 2:
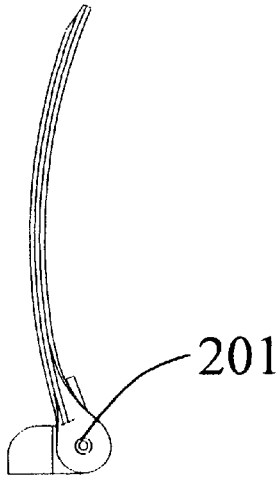
FIG. 2 is a side view of the wing deployer and locker.
Figure 3:
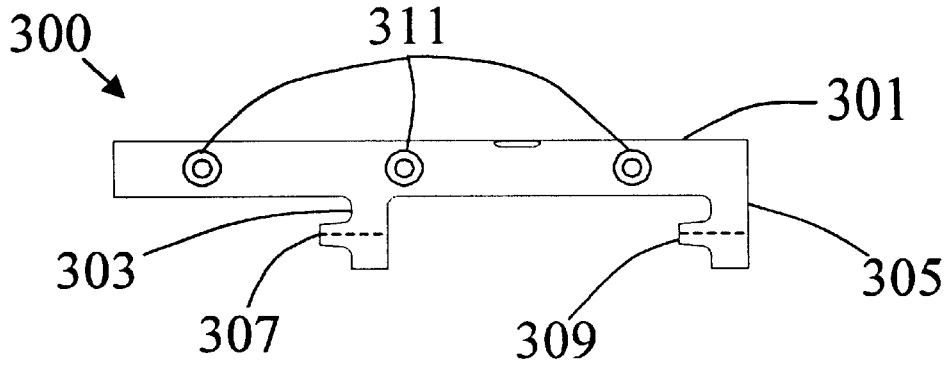
FIG. 3 illustrates the base with the plural teeth.

Referring now to the drawing wherein like numbers represent like parts in each of the several figures, FIG. 1 is a frontal view of the wing deployer and locker showing the assembly of wing 400 with base 300. A side view of the assembly is presented in FIG. 2. For explanation of the structure and operation of the wing deployer and locker, reference is made to FIGS. 3 and 4 which illustrate the base and the wing, respectively.

Base 300 is elongated and made up of rod 301, multiple arms, such as first arm 303 and second arm 305 protruding from the rod and multiple identical teeth such as first tooth 307 extending from the first arm and second tooth 309 extending from the second arm. The rod, arms and the teeth may be of one smooth continuous construction to render them strength and stability. Each of the several teeth has a cylindrical hole along its axis (indicated by the dotted line) and is shaped at a tapering angle as is further explained in FIG. 5. Base 300 is fixedly attached to the body of the flying object by use of suitable screws and the several holes 311.

Figure 4:
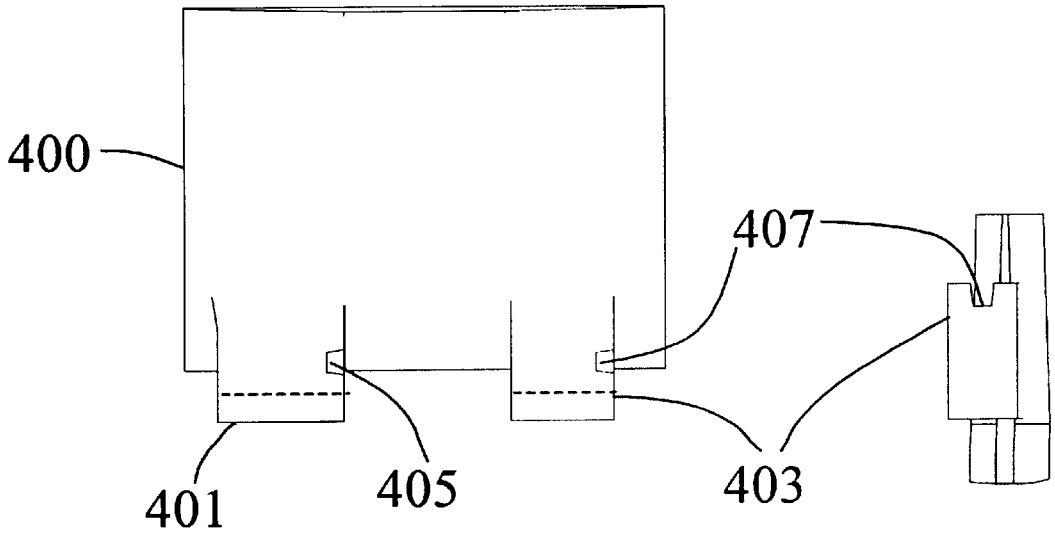
FIG. 4 shows a frontal view and a side view of the wing with the arms and the bosses.

Wing 400, depicted in FIG. 4, can be the wing of any flying object. It has multiple wing bosses such as first boss 401 and second boss 403. These first and second bosses extend from the bottom side of the wing and have first slot 405 and second slot 407, respectively, therein. The slots are shaped and tapered to match teeth 307 and 309 of the base. A cylindrical cavity also runs through the bosses along their axis (indicated by the dotted line) which is identical with the axis of the teeth.

Figure 5:
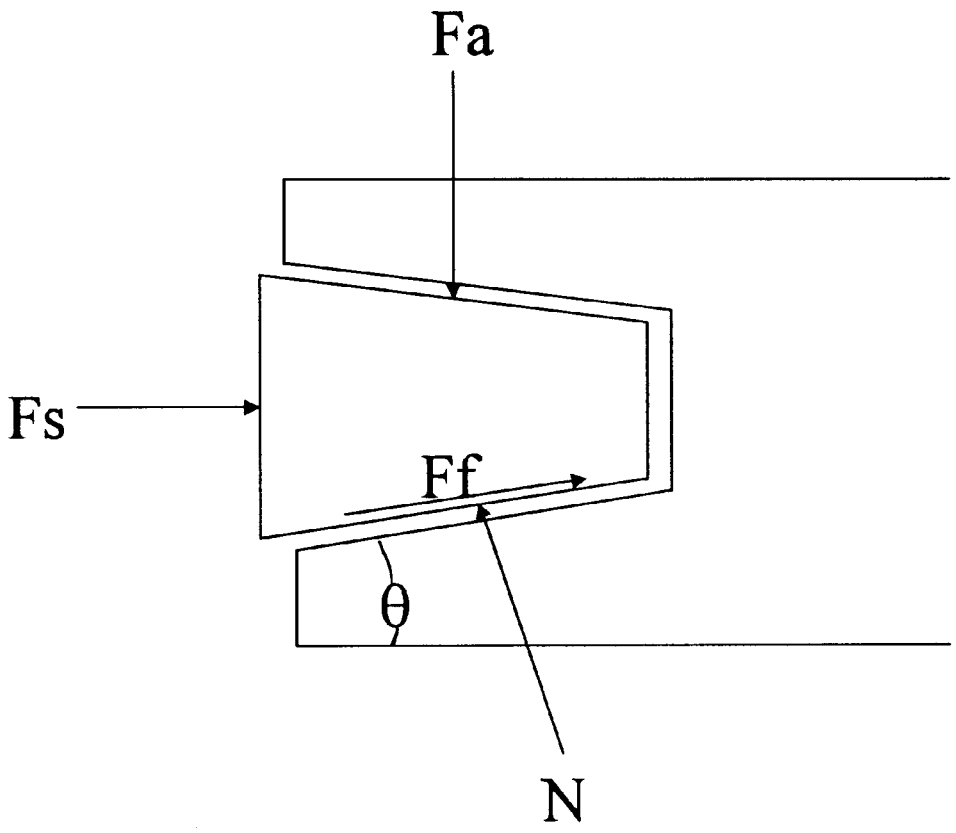
FIG. 5 illustrates the taper angle of the teeth and the slots.

The wing and the base are assembled, as shown in FIG. 1, and held together by pin 201 that is inserted through the cylindrical hole passing through the wing bosses and the teeth. Until launch, the flying object is stored inside a canister with the wing in the folded and stowed position. However, upon release of the object from the canister, the wing begins to open by rotating around pin 201. The torque to open the wing is provided by torsion spring 103 which is wound around the pin and located between first tooth 307 and second boss 403 and which is further coupled between the wing and the base and compels the wing to move away from its stowed position. Then, five degrees before the wing is fully open, slots 405 and 407 begin to mesh with teeth 307 and 309 in the base. Over the last five degrees of wing opening, compression spring 101, also wound around pin 201 but under the torsion spring, acts linearly between the wing and the base (i.e. translates the wing aft by a predetermined distance) to engage the teeth into the slots. When the slots are fully aligned with the teeth and completely mated, rotation of the wing stops. The wing is locked fully open at this point and is capable of withstanding aerodynamic loading without unlocking. The engagement and locking is facilitated by the 5 degree taper on both the teeth and slots. This particular taper angle is chosen so that, under torque loading, the friction between the tooth and the slot is greater than the reaction component attempting to cam the tooth out of the slot. This is illustrated in FIG. 5 where $F_a$ is the aerodynamic force tending to separate the tooth from the slot, $F_s$ is the force exerted by compression spring 101, $F_f$ is the function force, N is the normal force between the tooth and slot and $\Theta$ is the taper angle. In order to determine the maximum taper angle of the tooth to prevent camming out, the horizontal direction forces are examined.

$$F_s+\mu N\cos(\Theta)-N\sin(\Theta)=0$$

Where $\mu$ denotes the coefficient function between the tooth and the slot. If $F_s$ is set to zero, motion is impending for $\mu\cos(\Theta)-\sin(\Theta)=0$. If $\mu$ is set to 0.1, then the latter equation can be solved for the maximum taper angle which is 5.7 degrees. Therefore, if the taper angle is less than 5.7 degrees, then the tooth will have no tendency to cam out of its slot under load.

Two of the wing deployer and locker assembly as described above are to be used on each wing of a flying object for stability and assurance of positive locking of the open wing for the duration of the flight.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

I claim:

1. A deployable wing and a device for deploying and locking said wing, in the fully deployed position, said wing residing on a flying object, the object being stored in a canister with said wing in a folded state until release, said wing and device comprising; an elongated base, said base comprising a rod, a plurality of arms extending from said rod and a plurality of teeth protruding from said arms, said rod having a means for fixed attachment to the body of the flying object and each of said teeth having a cylindrical hole therethrough; a pin suitable for being inserted through said cylindrical holes, thereby connecting said teeth; a plurality of wing bosses extending from said wing, each of said bosses being adapted for mating with one of said teeth; a means for unfolding said wing and a means for motivating said teeth to mate with said bosses as said wing unfolds so as to lock said wing in the fully deployed position.

2. A device for deploying and locking, in the fully deployed position, a foldable wing of a flying object as set forth in claim 1, wherein said plurality of bosses and teeth are a first boss and a second boss, a first tooth located between said first boss and said second boss and a second tooth, said second tooth being located on opposite side of said second boss away from said first tooth.

3. A device for deploying and locking a foldable wing as set forth in claim 2, wherein said mating adaptation is a slot at one side of each of said bosses, said slot being positioned and shaped to accept and hold therein one of said teeth.

4. A device for deploying and locking as set forth in claim 3, wherein said bosses, slots, teeth, unfolding means and motivating means have a common axis, said axis being parallel with said rod.

5. A device for deploying and locking as set forth in claim 4, wherein said first and second bosses each further has therethrough a cylindrical cavity, said cavity being suitable for having inserted therein said pin.

6. A device for deploying and locking as set forth in claim 5, wherein said motivating means is a compression spring, said compression spring being positioned between said first tooth and said second boss while being wound around said pin, said compression spring having sufficient tension to cause said bosses to be translated linearly along said common axis at a pre-determined time such that said teeth and slots are mated together by said teeth slipping into said slots.

7. A device for deploying and locking as set forth in claim 6, wherein said slots and said teeth are tapered by a pre-selected angle to generate sufficient friction between each pair of slot and tooth to prevent their separation after mating.

8. A device for deploying and locking as set forth in claim 7, wherein said unfolding means is a torsion spring, said torsion spring being positioned between said first tooth and second boss while being wound around said compression spring, said torsion spring being further coupled between said rod and said wing such that said torsion spring compels said wing to unfold upon the release of the flying object from the canister.

9. A device for deploying and locking as set forth in claim 8, wherein said fixed attachment means of said rod comprises at least two holes drilled into said rod, said holes being suitable for accepting screws therethrough to bolt said rod onto the body of the flying object.

10. A device for deploying and locking as set forth in claim 9, wherein said taper angle is 5 degrees.

* * * * *